US005125877A

United States Patent [19]

Brewer

[11] Patent Number: 5,125,877

[45] Date of Patent: Jun. 30, 1992

[54] SIMULATED CLIMBING WALL

[75] Inventor: George Brewer, Newton Center, Mass.

[73] Assignee: Brewer's Ledge, Inc., Boston, Mass.

[21] Appl. No.: 504,956

[22] Filed: Apr. 5, 1990

Related U.S. Application Data

[63] Continuation-in-part of Ser. No. 471,207, Jan. 26, 1990, abandoned.

[51] Int. Cl.[5] ..... A63B 7/00

[52] U.S. Cl. ..... 482/7; 482/37

[58] Field of Search ..... 272/69, 70, 96, 112, 272/113, 129, 130, DIG. 4, 118

[56] References Cited

U.S. PATENT DOCUMENTS

| | | | |
|---|---|---|---|
| 3,032,344 | 5/1962 | Hjelte | 272/112 |
| 3,592,466 | 7/1971 | Parsons | 272/69 |
| 4,512,570 | 4/1985 | Tardivel | 272/112 |
| 4,609,189 | 9/1986 | Brasher | 272/118 |
| 4,614,337 | 9/1986 | Schonenberger | 272/69 |
| 4,645,205 | 2/1987 | Wolff | 272/DIG. 4 X |
| 4,687,195 | 8/1987 | Potts | 272/69 |
| 4,708,337 | 11/1987 | Shyu | 272/69 |
| 4,726,581 | 2/1988 | Chang | 272/70 |
| 4,822,029 | 4/1989 | Sarno et al. | 272/70 |
| 4,848,737 | 7/1989 | Ehrenfield | 272/70 |
| 4,923,191 | 5/1990 | Persico | 272/69 |

FOREIGN PATENT DOCUMENTS

| | | | |
|---|---|---|---|
| 2006887 | 9/1971 | Fed. Rep. of Germany . | |
| 3502127 | 5/1988 | Fed. Rep. of Germany . | |
| 3739702 | 6/1989 | Fed. Rep. of Germany . | |
| 3815564 | 11/1990 | Fed. Rep. of Germany . | |
| 1204219 | 1/1986 | U.S.S.R. | 272/112 |
| 1227215 | 4/1986 | U.S.S.R. | 272/112 |

*Primary Examiner*—Robert Bahr

*Attorney, Agent, or Firm*—Bromberg & Sunstein

[57] ABSTRACT

The simulated climbing wall of the present invention is comprised of a frame, at least two guide members rotatably attached at the top of the frame, and a chain structure, including a plurality of climbing wall panels, each wall panel having a removable surface panel, wherein each wall panel is flexibly attached to the next in a continuous chain. The chain structure is guided by the guide members such that the simulated climbing wall has an orientation with respect to vertical that corresponds to the orientation of the guide members such that the pitch angle of the climbing wall is adjustable and such that the panels may be moved downwardly in a controlled manner as the climber climbs.

2 Claims, 9 Drawing Sheets

SIMULATED CLIMBING WALL

This is a continuation-in-part of copending application Ser. No. 07/471,207 filed on Jan. 26, 1990, now abandoned.

TECHNICAL FIELD OF THE INVENTION

The invention is related to the field of exercise devices and more particularly to simulation equipment for sport practice and rock climbing.

BACKGROUND OF THE INVENTION

Exercise stair devices having continous-loop moving-stair components are known. Ehrenfield in U.S. Pat. No. 4,848,737 discloses a moving ladder exercise device whose speed is regulated by a microprocessor to keep the climbers heart-rate constant. Chang in U.S. Pat. No. 4,726,581 discloses a stair-climbing simulation device having a speed-reduction brake system that makes use of a controlled hydraulic resistance to regulate the speed. Sarno et al., U.S. Pat. No. 4,822,029 discloses an exercise simulator having channel members, pivotally mounted to offer various degrees of steepness. None of these devices simulate a rock climbing situation and, specifically, none of them provide a flat climbing surface or a safe, inexpensive structure suitable for rock climbing practice.

SUMMARY OF THE INVENTION

The present invention provides a simulated climbing wall for a climber to climb up on, comprising: a frame; an articulated wall in the form of a continuous chain structure including a plurality of climbing wall panels hingedly attached, one to the next, in the form of a chain; and suspension means, affixed to the frame, for supporting the articulated wall in such a way that the panels may move downwardly as the climber climbs the articulated wall.

A preferred embodiment includes two channel members, each pivotally attached at its upper end to the frame and panels having rollers on their edges the rollers riding within the channel members. Each panel has a removeable surface board. The suspension assembly, mounted on top of the frame, includes an automotive rear axle assembly with wheels and a brake. The articulated wall may rotate over the wheels in the manner of a belt on a pulley but normally the brake is locked on and the brake prevents movement of the wall surface. When the climber reaches a predetermined height on the wall surface, a rope attached to the climbers waist releases the brake and the weight of the climber causes the wall surface to descend. The channel members are pivotally adjustable with respect to the frame such as to allow adjustment of the pitch angle of the wall surface and thereby present to the climber a wall surface that is alternatively a steep slope, a vertical wall or an overhang.

BRIEF DESCRIPTION OF THE DRAWINGS

A more complete appreciation of the present invention and the many attendant advantages thereof will be readily apparant by reference to the following description when considered in connection with the accompanying drawings wherein.

wherein the same element is referred to by the same reference numeral throughout the several views.

DETAILED DESCRIPTION OF THE INVENTION

Figure 1:
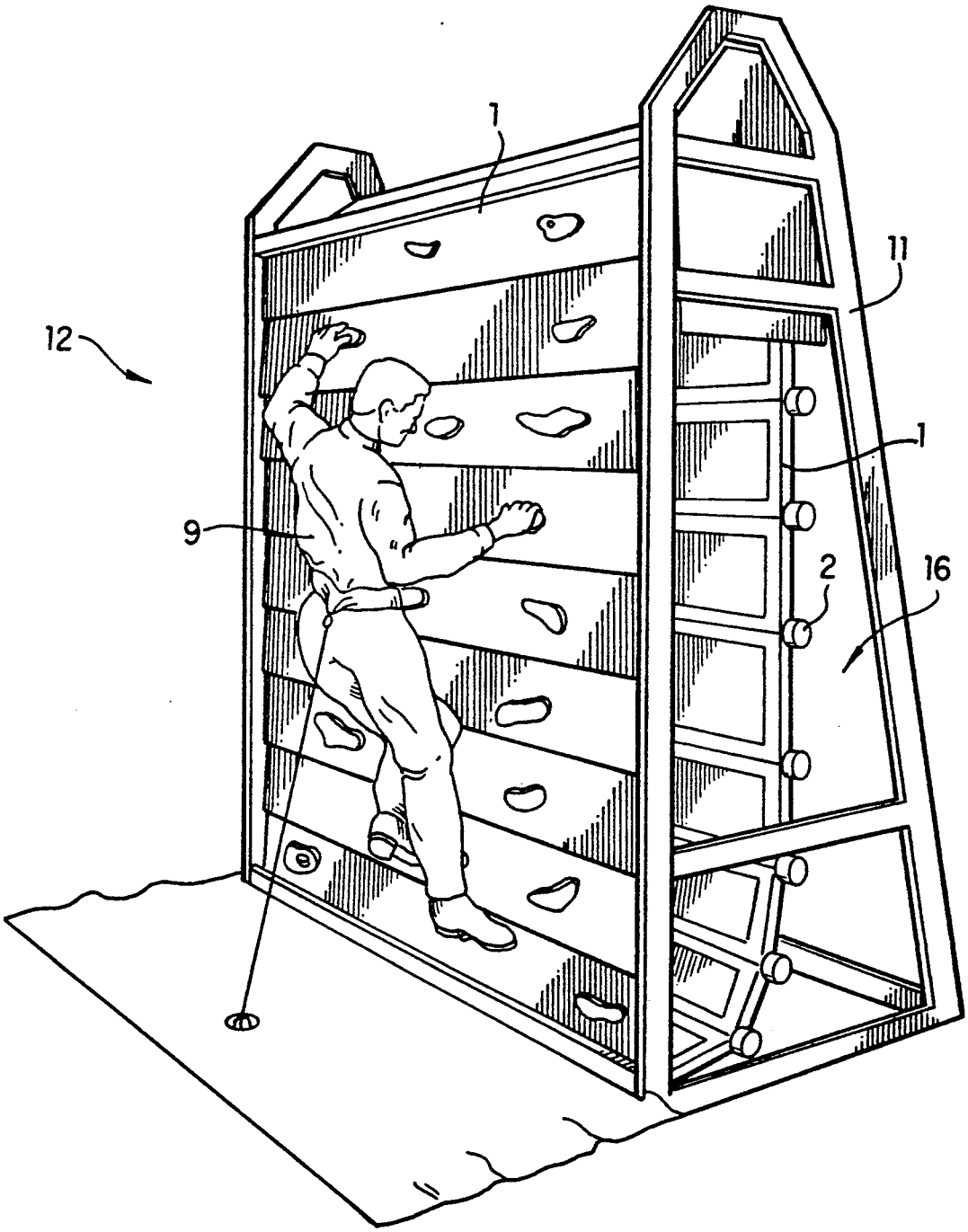
FIG. 1 is a perspective view of the simulated climbing wall.

FIG. 1 shows the invention assembled on a frame (11). An articulated wall structure (12) having flat faced panels (1) is disposed so that it provides a flat simulated climbing wall for the climber to climb up.

Figure 2:
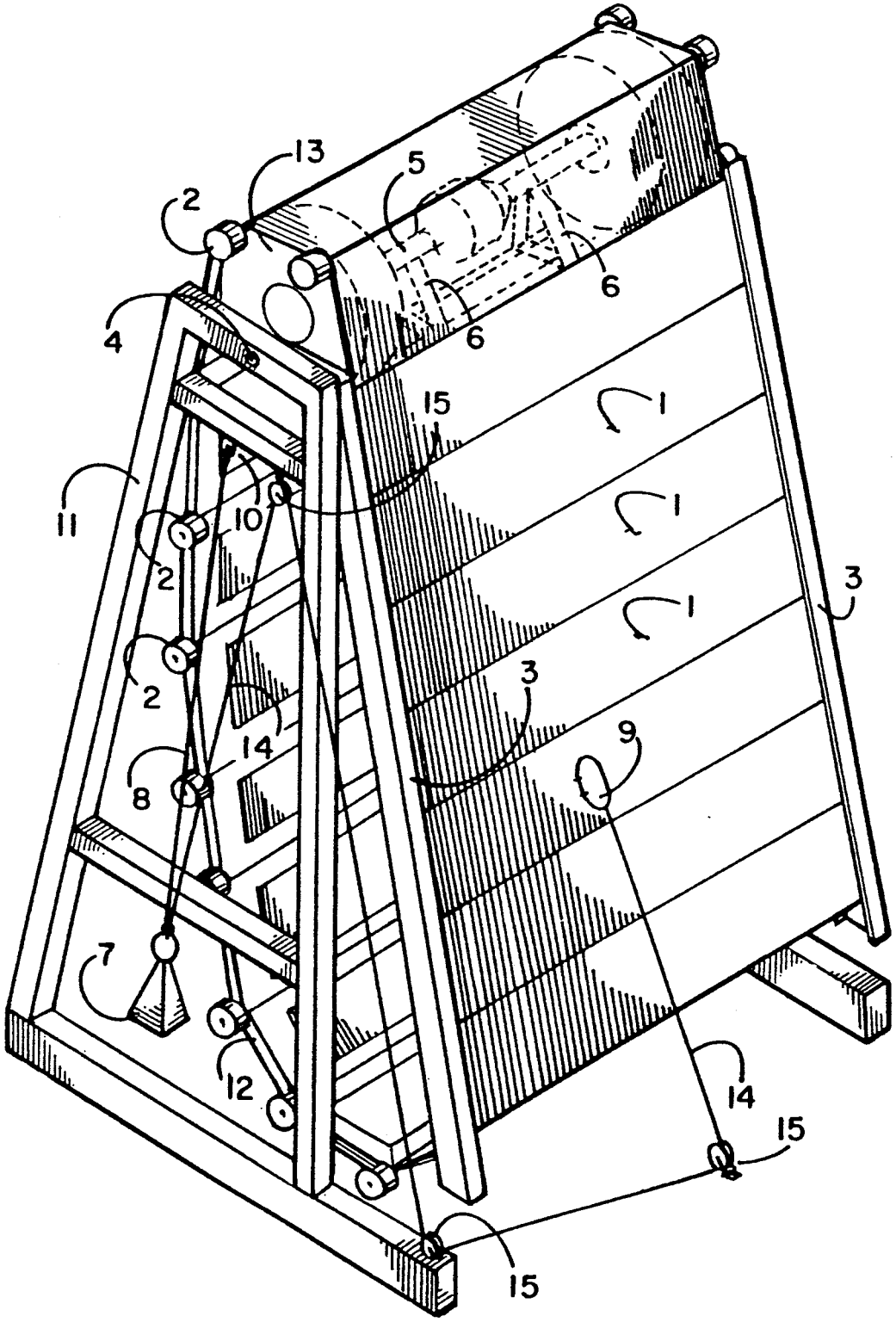
FIG. 2 is a perspective cut away view of the simulated climbing wall.
Figure 6:
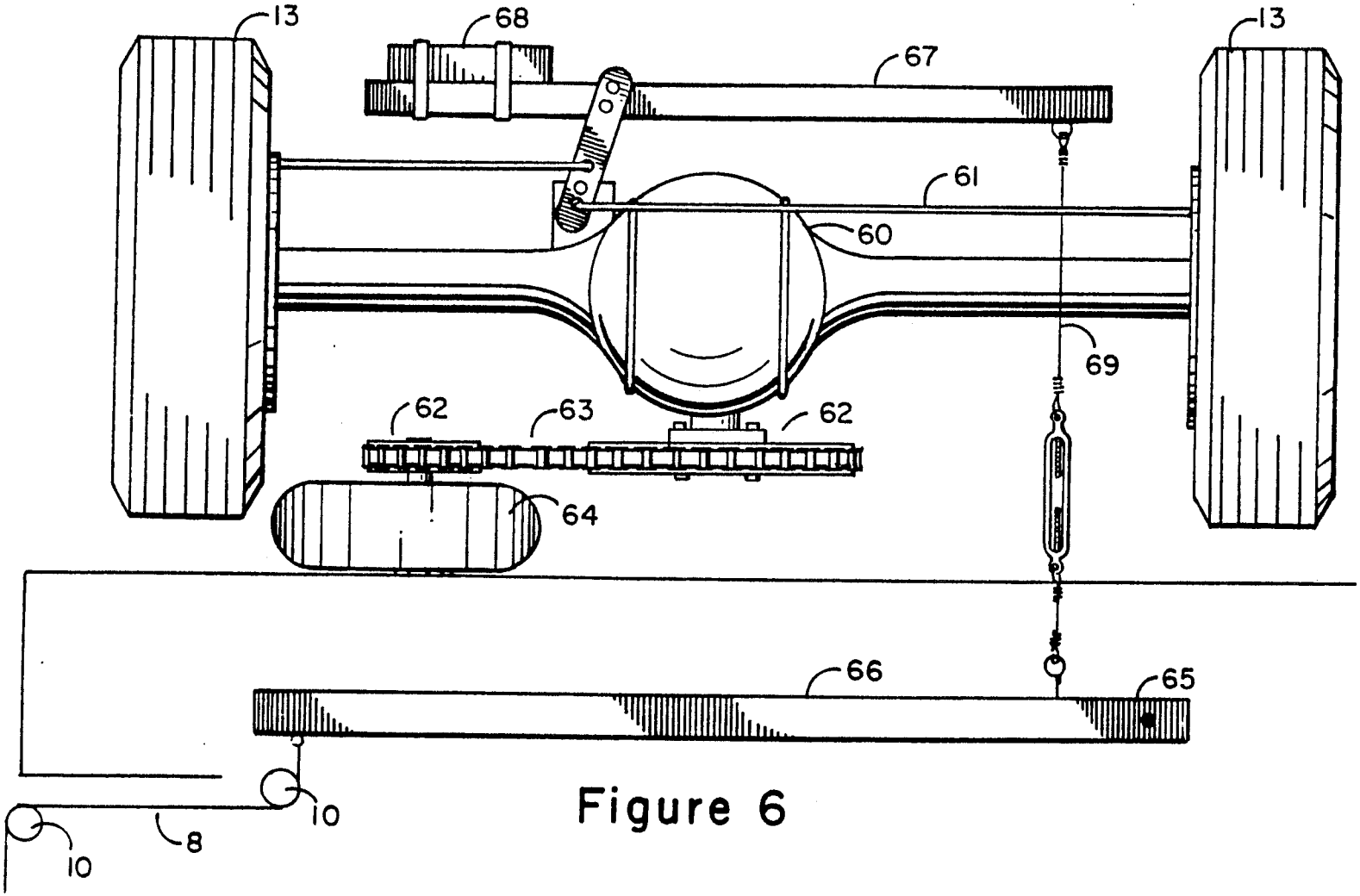
FIG. 6 is a partial cut away elevation view of the simulated climbing wall showing the suspension assembly and the brake and damper mechanisms.

FIG. 2 shows the articulated wall structure (12) and the flat faced panels (1) and rollers (2) disposed so that the rollers ride within facing channels of channel members (3) thereby providing a flat simulated climbing wall face between the channel members. Frame (11) serves as a mount for two pivotally mounted channel members. The two channel members (3) are pivotally mounted on pivots (4). These pivots allow adjustment of the pitch angle of the climbing wall The weight of the articulated wall structure is supported by a suspension assembly (5) which is mounted within a cradle (6) on top of frame (11). The suspension assembly includes brakes (not shown), one on each wheel. A three pound weight (7) is supported by a rope (8) which runs over pulleys (10). FIG. 6 shows the other end of rope (8), which runs through a system of pulleys (10) attached to a first lever (66). The first lever is attached via linkage wire (69) to a second lever (67). The second lever is attached to brake actuating rods (61) which are attached to the brakes. Returning now to FIG. 2, second rope (14) is attached to the three pound weight (7) and runs over pulleys (15). The other end of rope (14) is attached to a carabiner (9) which may be attached to the climber's waist such that when the climber passes the predetermined height, rope (14) may release the brake.

Figure 3:
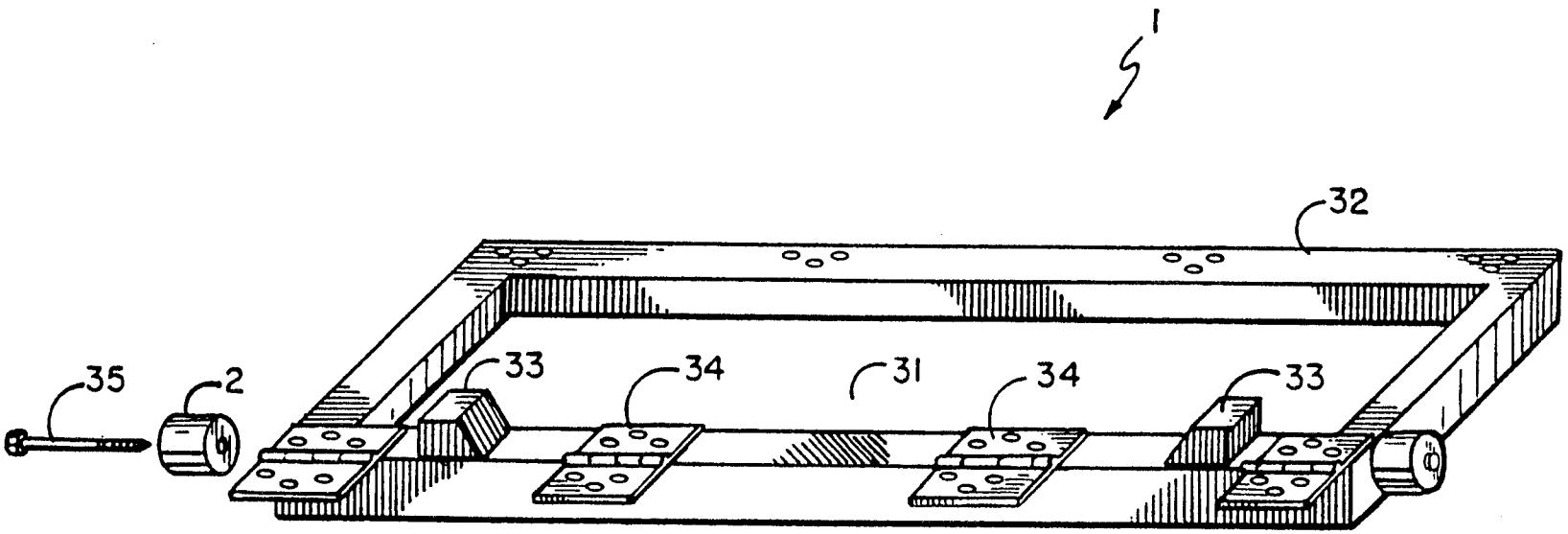
FIG. 3 is a perspective view of one embodiment of the climbing wall panel.

FIG. 3 shows detail of one embodiment of climbing wall panel (1). The perspective shown is from the inside of the articulated wall structure of FIG. 2. If the climbing wall face is considered the front side of the panel, FIG. 3 shows the back side. A panel frame (32) contains a surface board (31). In a preferred embodiment each surface board is a 1'×6', ½" plywood sheet and the panel frame is made of 1½ inch square steel tubing. Climbing holds may be attached to the face of the panel by a variety of means. Adjacent panels are hinged together on the back of the frame members by four hinges (34). The two outer hinges have long bolts (35) which serve as hinge pins and also as axles for rollers (2). In this embodiment bumper blocks (33) in the articulated wall structure assembly serve to keep the panels centered on the suspension assembly.

Figure 4:
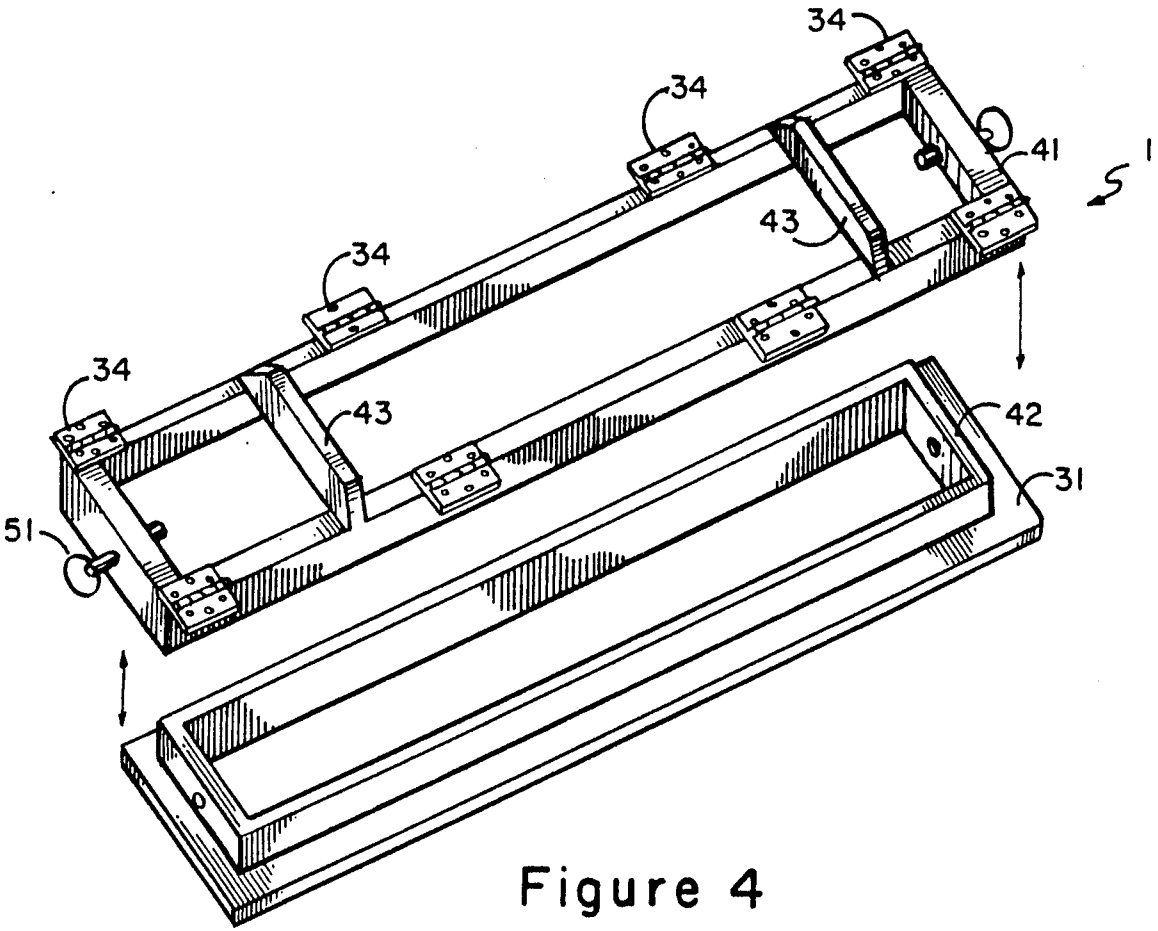
FIG. 4 is a perspective view of another embodiment of the climbing wall panel showing the removeable surface board.
Figure 5:
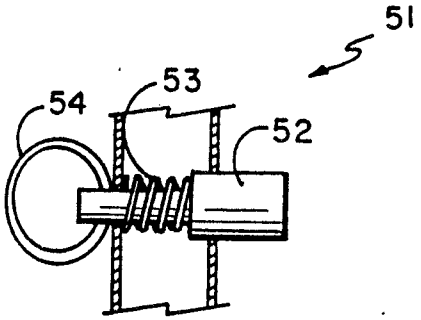
FIG. 5 is a partial cutaway view of the surface board fastening mechanism.

FIG. 4 shows detail of a preferred embodiment of climbing wall panel (1). The perspective shown is from the inside of the articulated wall structure of FIG. 1. If the climbing wall face is considered the front side of the panel, FIG. 4 shows the back side. A panel has a first frame (41), a second frame (42) and a surface board (31) attached to the second frame. In a preferred embodiment each surface board is a 1'×6', ½" plywood sheet and each frame is made of 1½ inch square steel tubing. Climbing holds may be attached to the face of the surface board by a variety of means. Adjacent panels are hinged together on the back of the first frame members by four hinges (34). The two outer hinges have long bolts which serve as hinge pins and also as axles for rollers. The first frames are made of welded square-section steel tubing and are hinged together. The surface boards have a second frame mounted on the reverse side. Each second frame fits inside its corresponding first frame and is secured by spring loaded pins in the ends of the first frames that engage with holes in the second frames. The second frames, made of maple or other strong lightweight material, serves the dual function of positioning the panel on the first frame and also stiffening the panel so that it will not bow out under the pull of the climber. A preferred embodiment of the surface board fastening means, a spring-plunger, is shown in FIG. 5. This consists of a pin (52), a spring (53) and a ring (54). FIG. 4 shows two spring-loaded pins, one at each end of the second frame. The surface board may be released for removal by pulling either pin. Both pins are accessible on panels that are at the back of the climbing frame, in curtain wall (16) of FIG. 1. The panel is accessible from either side and may be removed by one person.

FIG. 6 shows a top view of the suspension assembly and in particular the braking and damping system. FIG. 6 shows two wheels (13) mounted on an automotive rear axle assembly differential unit (60). The wheels support the weight of the articulated wall structure and allow the articulated wall structure to move down, under the weight of the climber, when the brakes are released. The brakes are normally on nd are released when the climber passes a predetermined height on the wall. When the climber passes the predetermined height, the rope (14) which is attached to his waist by a carabiner, passing over pulleys (15) becomes taut and lifts the 3 lb. weight (7). This releases the pressure of the weight (7) from the rope (8) which runs through pulleys (10) and is attached to the first lever (66). Thus released, the first lever (66) rotates about pivot (65) which via linkage wire (69) causes second lever (67) to release the brake via brake actuating rods (61). The rate of movement of the wheels and therefore the rate of descent of the articulated wall structure under the influence of the weight of the climber is controlled by damper (64) which is linked via chain sprocket (62) and chain (63) to the wheels via the automotive rear axle assembly differential unit. A counterweight (68) balances the weight of levers (66) and (67). Other brake and lever arrangements and other means for supporting the articulated wall and allowing the wall to move vertically may be used. Also non-mechanical brakes may be used such as might be provided electro-mechanically by an electric motor.

Figure 7:
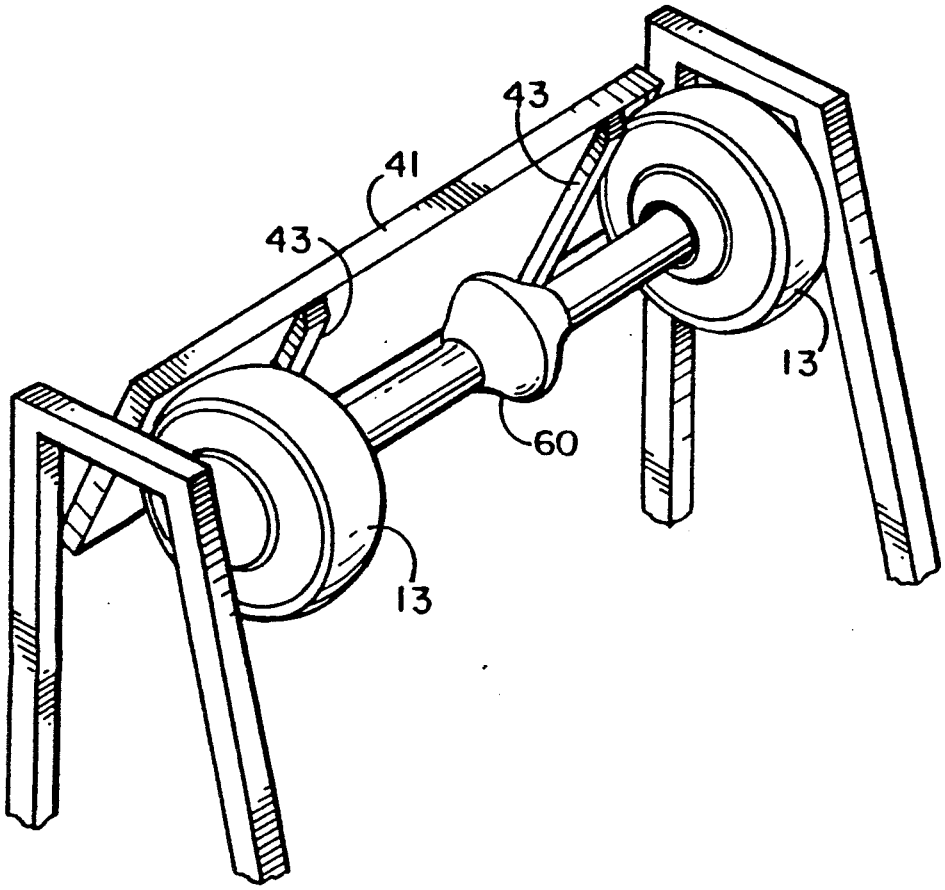
FIG. 7 shows a partial cutaway top view of the suspension assembly and the bumper bars.

In a preferred embodiment, using the panels shown in FIG. 4, bumper bars serve to keep the panels centered on the suspension assembly. The bumper bars (43) are shown in FIG. 4 and are square-section metal tubing members welded onto the back of the first frames. The ends of the bumper bars are cut at an angle of approximately 45 degrees. The bumper bars serve three functions. First, they serve to keep the curtain wall centered on the wheels of the suspension assembly while the climbing wall is in use. Second, they serve to strengthen the first frame. Third, when the frame hinges fold in the course of operation, they limit the degree of folding to an angle of approximately 90 degrees which improves the smoothness of descent of the simulated wall. A cut away top view of a preferred embodiment of the suspension assembly showing the operation of the centering bumpers is shown in FIG. 7. Two wheels (13) are mounted on an automotive rear axle assembly differential unit (62). The wheels support the weight of the articulated wall structure and allow the articulated wall structure to move down, under the weight of the climber, when the brake is released. First frames (41) ride over wheels (13) such that bumper bars (43) maintain the centered alignment of the frames when the simulated climbing wall turns during use.

Figure 8:
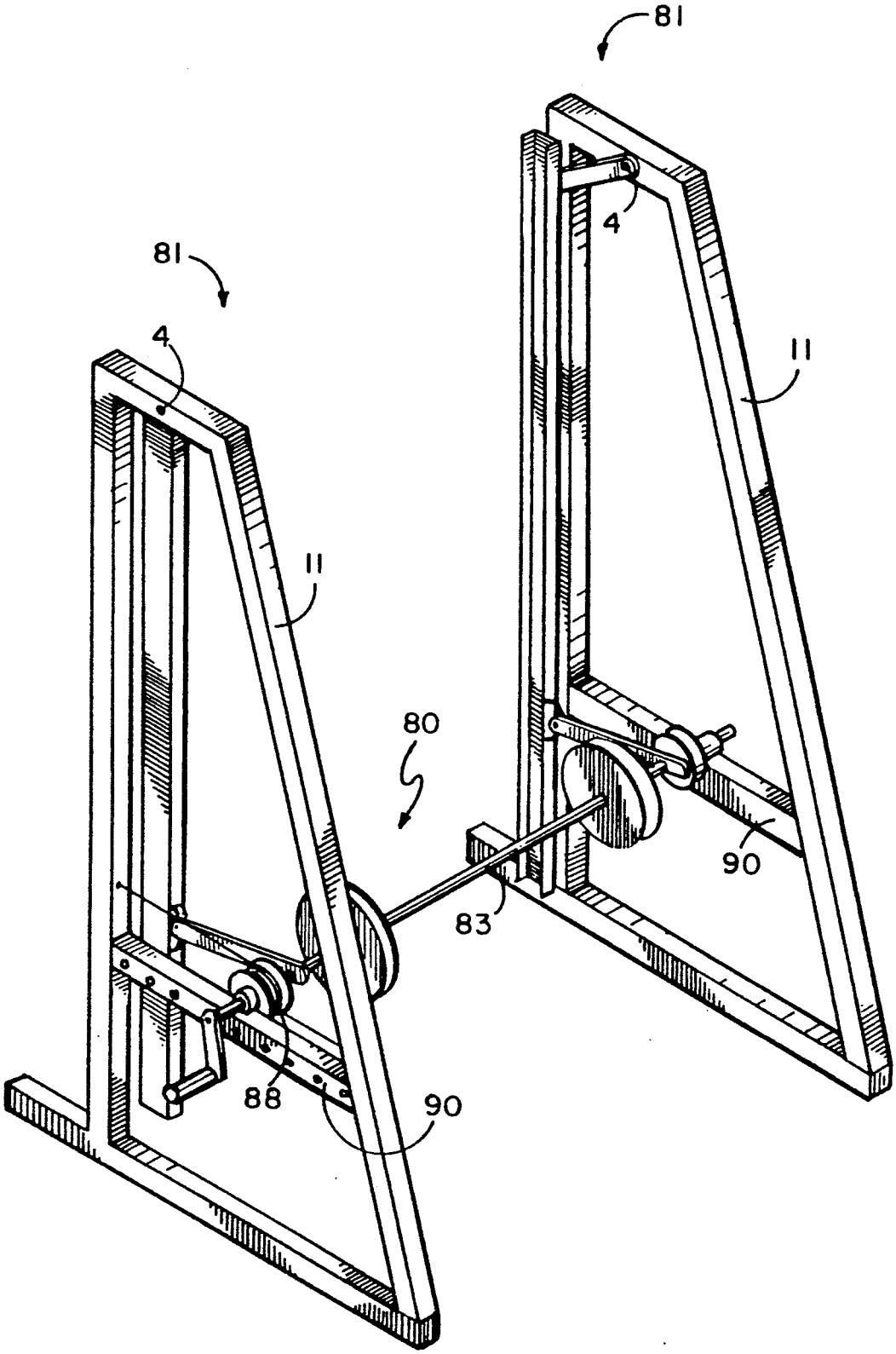
FIG. 8 is a partial cut away perspective view of the cantilever frame and the wall angle adjustment mechanism.
Figure 9:
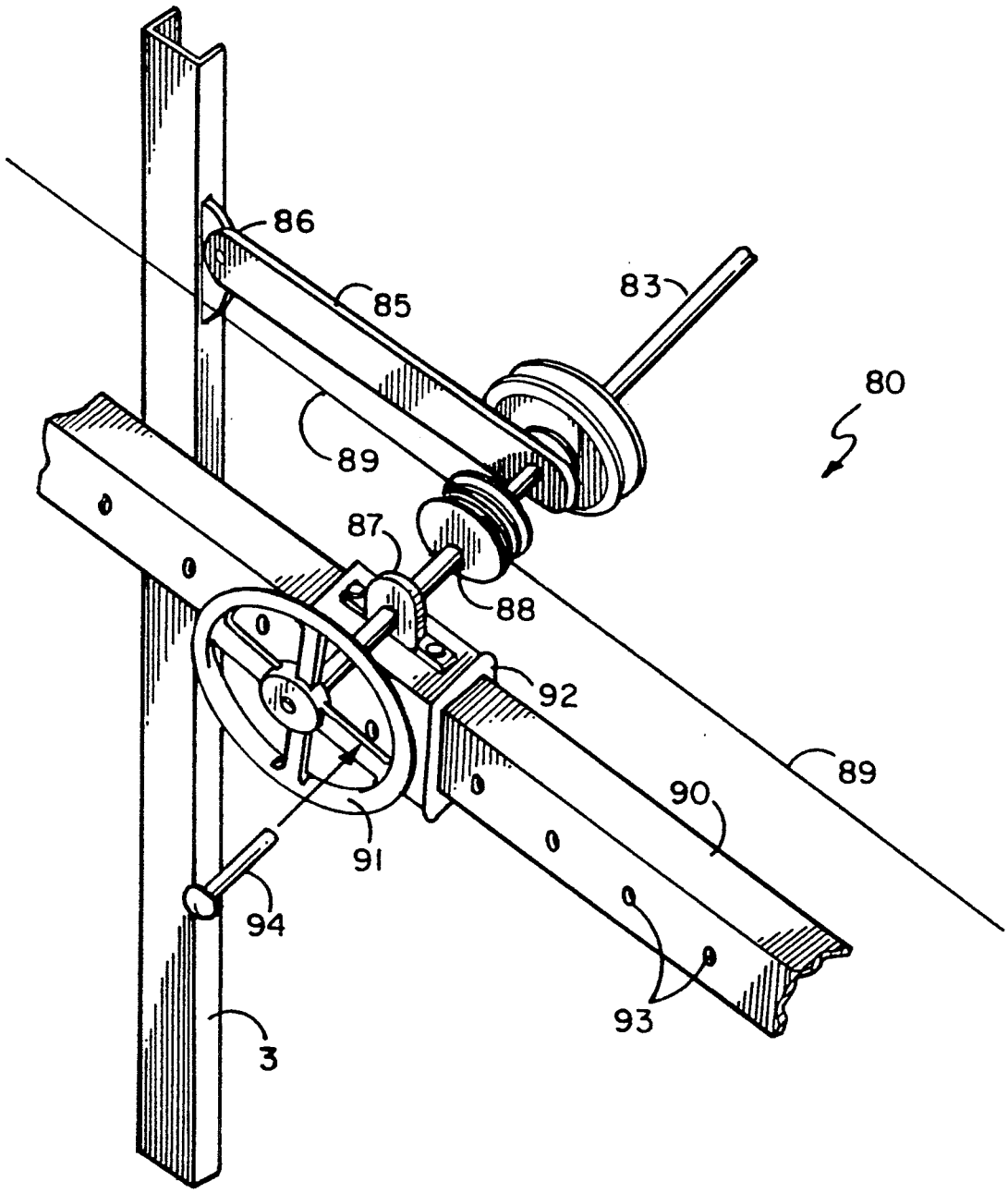
FIG. 9 shows further detail of the wall angle adjustment mechanism.

A preferred embodiment of the cantilever frame is shown in FIG. 8. The frame, which is made of lightweight metal such as aluminum or tubular steel, has a horizontal member (90). FIG. 8 also shows a preferred embodiment of the adjustment mechanism (80) for adjusting the vertical angle of the channel members and climbing surface. It is a very simple arrangement using a drum and cable arrangement. More detail is shown in FIG. 9. Referring now to FIGS. 4 and 5, drums (88) are carried by an axle (83) that runs across the machine between side frames (81). The axle is positioned behind the curtain wall (15 in FIG. 1). The axle turns in bearings (87) mounted on boxes (92) that may slide towards the front and back on horizontal member (90). The axle is turned by hand wheel (91). A handwheel is preferred over a crank for safety reasons. In the horizontal member proximate to the hand wheel, there are holes (93) in the horizontal member and a hole of the same size in the box so that a locking pin (94) may be inserted to hold the box at fixed settings. Drums (88) are mounted between the bearings on the axle. These drums have several turns of cable (89) wound around them. The middle of the cable is attached to the drum. The two free ends of each cable extend to the front and back of the machine where they are firmly attached to the frame and are stretched tight with a turnbuckle. Thus, when the axle is turned by a handwheel at one end, the entire assembly rides forward and backward on the cable. Between the drums, on either side, an arm (85) is pivotally attached to the axle at one end and to the channel member by pivot (86) at the other end. The axle carries two wheels (84), mounted between the arms, which hold the curtain wall well clear of the axle such as to prevent climbing holds attached to the surface board from coming into contact with the axle. Other mechanisms such as a rack and pinion mechanism or a mechanism including friction wheels may be used in place of the drum and cable assembly to adjust the wall angle.

Figure 10:
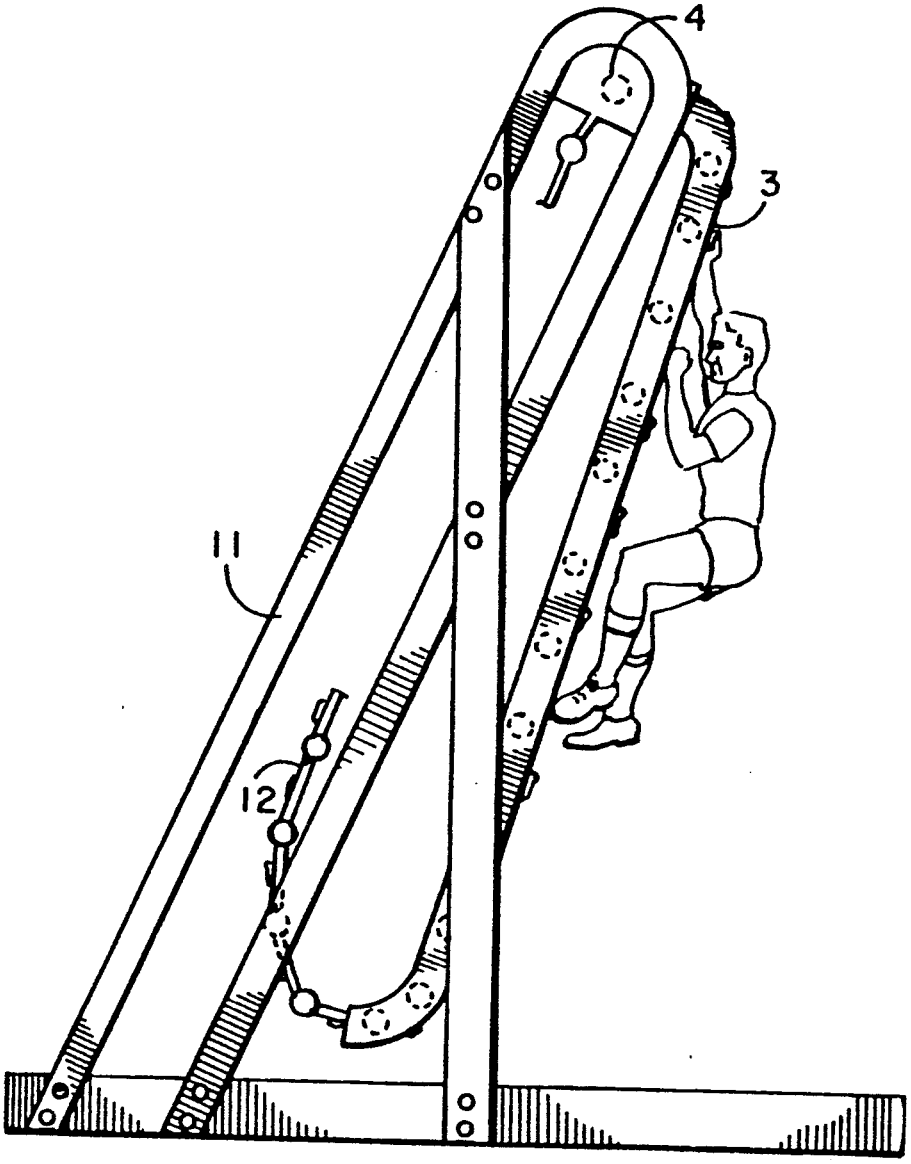
FIG. 10 is a side view of an alternative embodiment of the cantilever frame.

FIG. 10 shows a cantilever frame which, in a preferred embodiment, is of lightweight metal construction such as aluminum or tubular steel. This construction keeps obstructions well clear of the climbing wall face so that a falling climber will not sustain injury as a result of striking any part of the structure during a fall.

Operation of the Invention

The climber attaches the carabiner to his waist and begins to climb the simulated rock face. Initially, with the 3 lb. weight holding the brake on via a first rope, the simulated rock face is locked in place. When the climber reaches a predetermined height, a second rope, attached to the carabiner, lifts the weight, thereby releasing the brake, and the simulated rock face begins to descend under the climber's weight until the second rope becomes slack and the brake is reapplied.

Referring to FIG. 9, the angle of the simulated climbing wall may be changed by removing locking pin (94), turning hand wheel (91) until channel (3) is at the desired angle and the hole in box (92) is aligned with one of the holes (93) in horizontal frame member (90) and reinserting locking pin (94).

Referring to FIG. 1, a surface board may be removed when the board is at the back side of the climbing frame. Removal of one pin is sufficient allow the second frame to be taken out of from the first frame. Thus the task can be performed by one person from one side of the climbing frame.

What is claimed is:

1. A simulated climbing wall for a climber to climb up on, comprising:

a frame;

at least two guide members mounted to the frame;

a chain structure, including a plurality of substantially identical climbing wall panels each panel flexibly attached to the next in a continuous chain, the chain structure movably mounted so that a length of the chain structure is disposed between the guide members so as to constitute a simulated climbing wall with an orientation with respect to vertical that corresponds to the orientation of the guide members;

suspension means, affixed to the frame, for supporting the chain structure such that in a first mode the panels may be moved downwardly as the climber ascends the climbing wall and in a second mode the panels are prevented from moving;

position sensing means for sensing the position of the climber on the articulated wall means; and control means, in communication with the suspension means and the position sensing means, for causing the suspension means to shift between the first and second modes in accordance with the position of the climber on the climbing wall in such a way that the climber may be prevented from reaching the maximum height of the articulated wall means, including brake means for preventing the panels from moving, a weight and a rope, such that the rope may be attached to the climber and may lift the weight such that the brake means may be released when the climber reaches a predetermined height on the wall.

2. A simulated climbing wall for a climber to climb up on, comprising:

a frame;

at least two guide members, mounted to the frame;

a chain structure, including a plurality of substantially identical climbing wall panels each panel flexibly attached to the next in a continuous chain, the chain structure movably mounted so that a length of the chain structure is disposed between the guide members so as to constitute a simulated climbing wall with an orientation with respect to vertical that corresponds to the orientation of the guide members; and suspension means, affixed to the frame, for supporting the chain structure such that the simulated climbing wall may be moved downwardly as the climber climbs;

wherein the climbing wall panel includes a first frame having hinges, and further includes a removable surface panel, configured to accept climbing holds, having a second frame which may be removably attached to the first frame such that the surface panel may be removed without breaking the chain structure;

wherein the first frame may present a substantially horizontal surface to the second frame to support the downward force exerted by the second frame due to the weight of the climber on the surface panel; and wherein each climbing wall panel further includes a spring-loaded pin and the spring-loaded pin holds the removable surface panel in place.

* * * * *